US006633261B2

(12) United States Patent
Iwai et al.

(10) Patent No.: US 6,633,261 B2
(45) Date of Patent: Oct. 14, 2003

(54) ANTENNA AND WIRELESS DEVICE INCORPORATING THE SAME

(75) Inventors: Hiroshi Iwai, Neyagawa (JP); Atsushi Yamamoto, Osaka (JP); Koichi Ogawa, Hirakata (JP); Shinji Kamaeguchi, Kadoma (JP); Tsukasa Takahashi, Kawasaki (JP); Kenichi Yamada, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/988,716

(22) Filed: Nov. 20, 2001

(65) Prior Publication Data

US 2002/0075192 A1 Jun. 20, 2002

(30) Foreign Application Priority Data

Nov. 22, 2000 (JP) ..... 2000-355428

(51) Int. Cl.[7] ..... H01Q 1/38
(52) U.S. Cl. ..... 343/700 MS; 343/846; 343/860
(58) Field of Search ..... 343/700 MS, 702, 343/767, 770, 846, 848, 860, 861, 862

(56) References Cited

U.S. PATENT DOCUMENTS

| | | | | | |
|---|---|---|---|---|---|
| 4,907,006 | A | * | 3/1990 | Nishikawa et al. | 343/700 MS |
| 5,148,181 | A | | 9/1992 | Yokoyama et al. | 343/702 |
| 5,764,190 | A | | 6/1998 | Murch et al. | 343/702 |
| 5,767,810 | A | | 6/1998 | Hagiwara et al. | 343/700 MS |
| 5,926,139 | A | * | 7/1999 | Korisch | 343/700 MS |
| 6,008,762 | A | * | 12/1999 | Nghiem | 343/700 MS |
| 6,100,849 | A | * | 8/2000 | Tsubaki et al. | 343/700 MS |
| 6,218,991 | B1 | * | 4/2001 | Sanad | 343/700 MS |
| 6,297,776 | B1 | * | 10/2001 | Pankinaho | 343/700 MS |
| 6,346,914 | B1 | * | 2/2002 | Annamaa | 343/700 MS |

FOREIGN PATENT DOCUMENTS

| | | |
|---|---|---|
| EP | 0 993 070 | 4/2000 |
| JP | 2000-114856 | 4/2000 |

OTHER PUBLICATIONS

Abstract of JP 10190345 (Jul. 1998).
Salonen, P., et al. "A Small Planar Inverted–F Antenna for Wearable Applications", Wearable Computers, 1999. Digest of Papers. The Third International Symposium on San Francisco, CA, Oct. 1999, IEEE Comput. Soc., pp. 95–100.

* cited by examiner

*Primary Examiner*—Tan Ho
(74) *Attorney, Agent, or Firm*—Wenderoth, Lind & Ponack, L.L.P.

(57) ABSTRACT

An antenna is provided which can reconcile a low antenna resonance frequency and broadband frequency characteristics, while attaining stable impedance characteristics and enhanced design flexibility. A conductive plate is coupled to a conductive base plate via a first metal lead. A voltage is applied to the conductive plate from a supply point via a second metal lead. A conductive wall is electrically coupled to the conductive plate at one end thereof. An electromagnetic field coupling adjustment plate is electrically coupled to the other end of the conductive wall. The electromagnetic field coupling adjustment plate is disposed so as to leave a predetermined interspace between itself and the conductive base plate, thereby creating a capacitor in conjunction with the conductive base plate. The conductive wall and the electromagnetic field coupling adjustment plate are disposed so as to maximize a path length from a shot-circuiting portion (at which the conductive plate is coupled to the first metal lead) to an open end of the electromagnetic field coupling adjustment plate. Preferably, a current path extending from a supply portion (at which the conductive plate is coupled to the second metal lead) to the short-circuiting portion has a length equal to a ½ wavelength for a desired resonance frequency.

26 Claims, 12 Drawing Sheets

IN-PHASE MODE

ANTENNA AND WIRELESS DEVICE INCORPORATING THE SAME

BACKGROUND OF THE INVENTION

1. Field of the Invention

The present invention relates to an antenna and a wireless device incorporating the antenna. More particularly, the present invention relates to an antenna for mobile wireless communications which is especially useful in wireless devices such as mobile phone terminals, and a wireless device incorporating such an antenna.

2. Description of the Background Art

In recent years, technologies related to mobile communications, e.g., mobile phones, have seen a rapid development. In a mobile phone terminal, the antenna is a particularly important component. The trend for downsizing mobile phone terminals has required antennas to be downsized and also to become internalized elements.

Hereinafter, a conventional example of an antenna for mobile wireless communications, which may be used for a mobile phone terminal, will be described.

FIG. 16 schematically illustrates the structure of a conventional antenna for mobile wireless communications. As shown in FIG. 16, the conventional antenna for mobile wireless communications includes a conductive base plate 101, a conductive plate 102 of a planar configuration, and two metal leads 103 and 104. A predetermined voltage is supplied from a supply point 105 to the conductive plate 102 via the metal lead 103. Moreover, the conductive plate 102 is coupled to the conductive base plate 101, which provides as a ground (GND) level, via the metal lead 104.

An antenna of the above-described structure, commonly referred to as a PIFA (Planar Inverted F Antenna), is employed usually as a low-profile and small antenna device in a mobile phone terminal. The PIFA is a $\lambda/4$ resonator, which is equivalent to a $\lambda/2$ micro-strip antenna being short-circuited in a middle portion thereof to have its volume halved.

FIGS. 17A and 17B show current paths which emerge when a voltage is applied from the supply point 105 of the conventional antenna for mobile wireless communications shown in FIG. 16.

FIG. 17A shows a current path in an opposite phase mode. As shown by the arrows therein, the current path in the opposite phase mode begins at the supply point 105, extends through the metal lead 103 and along the lower surface of the conductive plate 102, and further extends through the metal lead 104 so as to be short-circuited to the conductive base plate 101. In the opposite phase mode, a current flowing through the metal lead 103 and a current flowing through the metal lead 104 do not contribute to the resonance of antenna because they have opposite phases and therefore cancel each other.

FIG. 17B shows a current path in an in-phase mode. As shown by the arrows therein, the current path in the in-phase mode begins at the supply point 105, extends through the metal lead 103 and along the lower surface of the conductive plate 102 so as to turn around at the open end, and further extends along the upper surface of the conductive plate 102 and through the metal lead 104, so as to be short-circuited to the conductive base plate 101. In the in-phase mode, a current flowing through the metal lead 103 and a current flowing through the metal lead 104 have the same phase at a frequency at which the length of the current path equals a ½ wavelength. Therefore, the antenna resonates at this frequency (referred to as the "resonance frequency").

FIG. 18 illustrates a detailed structure of the conventional antenna for mobile wireless communications shown in FIG. 16. As shown in FIG. 18, the conductive base plate 101 has a rectangular shape with a width of 40 mm and a length of 125 mm. The conductive plate 102 has a rectangular shape with a width of 40 mm and a length of 30 mm. The metal leads 103 and 104 are each 7 mm long. The volume occupied by the antenna (hereinafter referred to as the "occupied volume" of the antenna), which is defined within a region enclosed by an orthogonal projection of the conductive plate 102 on the conductive base plate 101, is equal to a product of the area of the conductive plate 102 and the lengths of the metal leads 103 and 104, i.e., 8.4 cc ($=3 \geqq 4 \geqq 0.7$), in this example.

In FIG. 18, the metal lead 103 functioning as a supply pin and the metal lead 104 functioning as a short-circuiting pin are shown with an interval of d therebetween. If the interval d is 3 mm, then the antenna shown in FIG. 18 will have a central frequency of 1266 MHz in the case of a 50Ω system. Since the bandwidth (i.e., frequency bandwidth which has a voltage-standing wave ratio (VSWR) equal to or less than 2) under these conditions is 93 MHz, a band ratio of this antenna is calculated to be 7.3% ($\approx$93/1266).

In the above-described conventional antenna for mobile wireless communications (PIFA), the resonance frequency and the length of the antenna element are generally in inverse proportion. Therefore, there is a problem in that the resonance frequency is increased if the length of the antenna element (i.e., the conductive plate 102), and hence the occupied volume of the antenna, is reduced in order to downsize the overall antenna.

Accordingly, there has been proposed an antenna structure for mobile wireless communications as shown in FIG. 19, which can provide a lower resonance frequency for the same occupied volume of the antenna.

As shown in FIG. 19, the conventional antenna for mobile wireless communications includes a conductive base plate 111, a conductive plate 112 of a planar configuration, a conductive wall 116, and two metal leads 113 and 114. A voltage is applied to the conductive plate 112 from a supply point 115, via the metal lead 113. The conductive plate 112 is coupled to the conductive base plate 111 via the metal lead 114. The conductive wall 116 is electrically coupled to the conductive plate 112 at one end thereof. Thus, the conductive plate 112 and the conductive wall 116 would together appear as if the conductive plate 102 in FIG. 16 was bent downward near its open end. A predetermined interspace exists between the other end of the conductive wall 116 and the conductive base plate 111. In this antenna structure, it is essential for the conductive wall 116 to be located at the farthest end of the conductive plate 112 from the metal lead 114.

The use of the above-described conductive wall 116 makes it possible to obtain a downsized antenna for the following two reasons.

First, an increased current path length lowers the resonance frequency. Specifically, the resonance frequency is lowered by disposing the conductive wall 116 so as to increase the maximum value of the current path length in the opposite phase mode (FIG. 20). Note that lowering the resonance frequency for the same occupied volume of the antenna is equivalent to downsizing an antenna while maintaining a constant resonance frequency. This is one reason why a downsized antenna can be realized by employing the structure shown in FIG. 19.

Second, the resonance frequency can be lowered due to capacitive loading. The interspace between the conductive wall 116 and the conductive base plate 111, which functions as shunt capacitance, is a factor in the lowering of the resonance frequency because the most intensive electric field resides at the open end of the conductive wall 116.

FIG. 21 illustrates a specific implementation example of the conventional antenna for mobile wireless communications shown in FIG. 19. Note that in the structure of FIG. 21, the dimensions of the conductive base plate 111 and the occupied volume of the antenna are the same as those of the structure of FIG. 18. In other words, the conductive plate 112 has a rectangular shape with a width of 40 mm and a length of 30 mm. The conductive wall 116 has a rectangular shape with a width of 6 mm and a length of 30 mm. The metal leads 113 and 114 are 7 mm long each.

If the interval d is 4 mm, then the antenna shown in FIG. 21 will have a central frequency of 1209 MHz in the case of a 50Ω system. Since the bandwidth under these conditions is 121 MHz, a band ratio of this antenna is calculated to be 10.0% (≈121/1209).

However, while the above-described conventional antenna structure for mobile wireless communications makes it possible to lower the resonance frequency by bending the antenna element (i.e., the conductive plate) near one end, there is a problem in that its frequency band becomes narrower as the resonance frequency is lowered. As for the reduction in the antenna resonance frequency which is realized by narrowing the interspace between the conductive wall and the conductive base plate, there is also a problem in that any variation in such a small interspace would affect the impedance characteristics more substantially than a larger interspace, so that the stability of the characteristics is undermined. Moreover, due to limited design flexibility, the capacitive coupling between the antenna element and the conductive base plate is inevitably increased in a low-profiled antenna, which makes impedance matching difficult.

SUMMARY OF THE INVENTION

Therefore, an object of the present invention is to provide an antenna which can reconcile a low antenna resonance frequency and broadband frequency characteristics, while attaining stable impedance characteristics and high design flexibility; and a wireless device incorporating the antenna.

The present invention has the following features to attain the object above.

According to the present invention, there is provided an antenna for use in a wireless device, the antenna comprising: a conductive base plate for providing a ground level; an antenna sub-element disposed on the conductive base plate; an electromagnetic field coupling adjustment element which is electrically coupled to the antenna sub-element, the electromagnetic field coupling adjustment element being disposed so as to have a predetermined interspace with respect to the conductive base plate; and a supply connection member for applying a predetermined voltage to the antenna sub-element.

Preferably, the antenna further comprises at least one short-circuiting connection member for short-circuiting the antenna sub-element to the conductive base plate. The electromagnetic field coupling adjustment element may be disposed so as to produce an electromagnetic field coupling effect in conjunction with the short-circuiting connection member, or a portion of the electromagnetic field coupling adjustment element may be disposed in a direction generally parallel to the conductive base plate to produce an electromagnetic field coupling effect in conjunction with the conductive base plate.

The electromagnetic field coupling adjustment element may be disposed so that a maximum path from the supply connection member to the short-circuiting connection member is equal to ½ of a wavelength for a desired resonance frequency, wherein the maximum path extends so as to turn around an open end of the electromagnetic field coupling adjustment element not coupled to the antenna sub-element.

Thus, according to the present invention, an antenna element is designed in a characteristic shape having an electromagnetic field coupling adjustment element, so as to utilize electromagnetic field coupling with the conductive base plate. By adjusting the electromagnetic field coupling between the antenna and the conductive base plate through the adjustment of the dimensions of the electromagnetic field coupling adjustment element as parameters, it is possible to obtain a slight difference between the resonance frequency of the antenna and the resonance frequency of the conductive base plate, thereby providing broadband frequency characteristics. Moreover, the ability to produce a lowered resonance frequency also enables antenna downsizing without compromising broadband impedance characteristics. Since an increased number of design parameters is introduced, impedance matching is facilitated.

Preferably, all or part of a space surrounded by the antenna sub-element, the electromagnetic field coupling adjustment element, and the conductive base plate is filled with a dielectric material. As a result, a higher level of capacitive coupling between the electromagnetic field coupling adjustment element and the conductive base plate can be expected due to the dielectric material used for filling. Thus, further antenna downsizing can be attained.

Preferably, the electromagnetic field coupling adjustment element is fixed to the conductive base plate via a support base composed of a dielectric material. As a result, a higher level of capacitive coupling between the electromagnetic field coupling adjustment element and the conductive base plate can be expected due to the support base composed of a dielectric material, while being able to stabilize the antenna element provided on the conductive base plate. This also makes it possible to accurately control the distance between the electromagnetic field coupling adjustment element and the conductive base plate, so that an improved mass-productivity can be expected.

Preferably, a slit is provided in at least one of the antenna sub-element or the electromagnetic field coupling adjustment element for elongating the path from the supply connection member to the short-circuiting connection member. By providing such a slit, the resonance frequency can be lowered, and further antenna downsizing can be expected. In this case, a substantial decrease in the resonance frequency can be obtained by providing slits in regions associated with intense current distributions. It will be appreciated that providing slits in the electromagnetic field coupling adjustment element also helps in controlling the capacitance created in conjunction with the conductive base plate.

Preferably, the electromagnetic field coupling adjustment element and the antenna sub-element are formed as one integral piece through bending. Thus, by forming the antenna sub-element and the electromagnetic field coupling adjustment element from one integral piece, the mechanical strength of the antenna and the mass productivity of the antenna products can be enhanced.

Furthermore, the antenna according to the present invention may be configured so that the antenna resonates with at least two frequencies. That is, the antenna may comprise a plurality of the short-circuiting connection members (or supply connection members) which are specific to different respective resonance frequency bands. One of the resonance frequency bands may be selectively supported by controlling conduction of the plurality of short-circuiting connection members (or supply connection members). Thus, an antenna structure for selectively supporting two different resonance frequency bands with a single antenna can be realized.

The short-circuiting connection member may be specific to a first resonance frequency band, and the antenna may further comprise a slot specific to a second resonance frequency band. The two resonance frequency bands may be simultaneously supported based on the action of the antenna sub-element and the slot. Thus, the entire antenna element (i.e., the antenna sub-element and the electromagnetic field coupling adjustment element) supports a first resonance frequency band, while the slotted portion supports a second resonance frequency band. Therefore, an antenna structure which simultaneously supports two resonance frequency bands with a single antenna can be realized.

Two implementations of the antenna may be disposed on a common conductive base plate, wherein predetermined voltages are applied to the two implementations of the antenna with a phase difference of about 180°. Based on this configuration, not only the aforementioned effects are obtained, but it is also possible to concentrate currents flowing on the conductive base plate in the neighborhood of the antenna element. As a result, the device characteristics can be prevented from deteriorating when a device incorporating the antenna is held in one's hand. By arranging the electromagnetic field coupling adjustment element so that the resonance frequencies of the two antennas are slightly different, more broadband-oriented characteristics can be expected.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
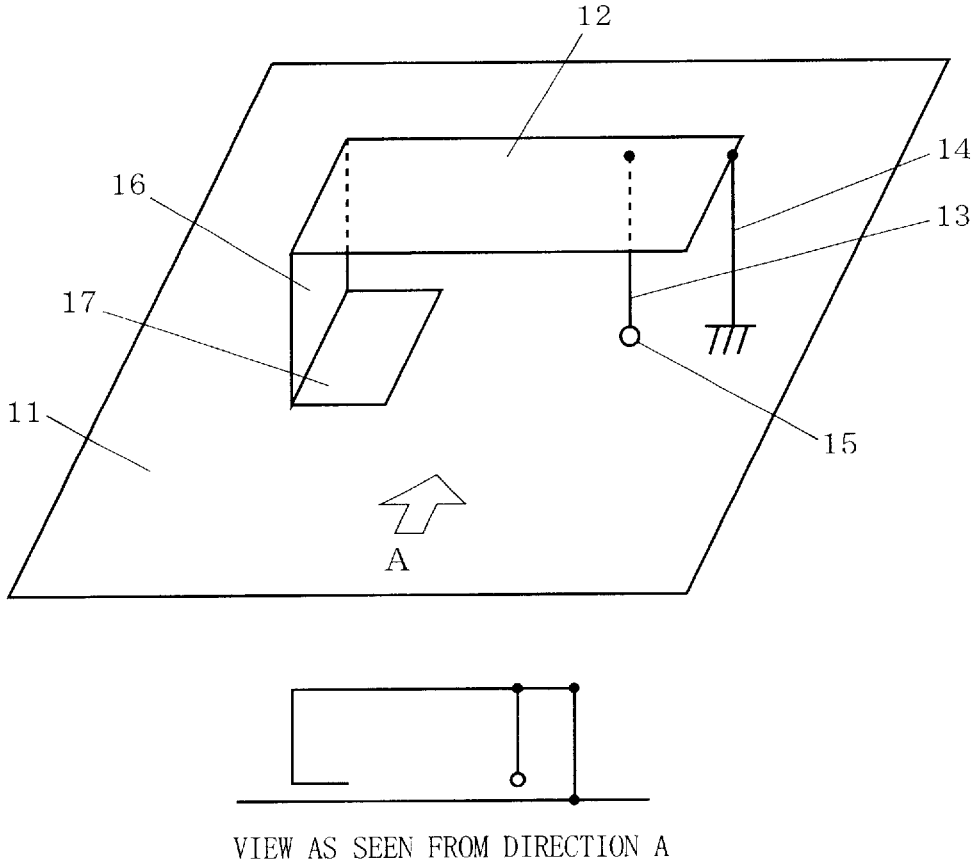
FIG. 1 is perspective view schematically showing an antenna structure according to a first embodiment of the present invention.

FIG. 1 is a perspective view schematically showing an antenna structure according to a first embodiment of the present invention. As shown in FIG. 1, the antenna according to the first embodiment includes: a conductive base plate 11; a conductive plate 12 having a planar configuration, which defines an antenna sub-element; a conductive wall 16 and an electromagnetic field coupling adjustment plate 17, which together define an electromagnetic field coupling adjustment element; and two metal leads 13 and 14. A voltage is applied to the conductive plate 12 from a supply point 15, via the metal lead 13. The conductive plate 12 is coupled to the conductive base plate 11 via the metal lead 14. The conductive wall 16 is electrically coupled to the conductive plate 12 at one end thereof The opposite end of the conductive wall 16 is electrically coupled to the electromagnetic field coupling adjustment plate 17.

According to the first embodiment, the electromagnetic field coupling adjustment plate 17 is disposed so as to leave a predetermined interspace between itself and the conductive base plate 11, thereby creating a capacitor in conjunction with the conductive base plate 11. The conductive wall 16 and the electromagnetic field coupling adjustment plate 17 are disposed (or coupled) so as to provide a relatively long path length between a portion of the conductive plate 12 which is coupled to the metal lead 14 (hereinafter referred to as a "short-circuiting portion") and the open end of the electromagnetic field coupling adjustment element. Preferably, the conductive wall 16 and the electromagnetic field coupling adjustment plate 17 are disposed in such a manner that a current path extending from a portion of the conductive plate 12 which is coupled to the metal lead 13 (hereinafter referred to as a "supply portion") to the short-circuiting portion has a length equal to a ½ wavelength for a given desired resonance frequency.

Based on this structure, it becomes possible to provide a lower resonance frequency for the same antenna element size (i.e., for the same occupied volume of the antenna), or alternatively realize a smaller antenna element size for the same resonance frequency, than is possible with conventional antenna structures. Also based on this structure, it is possible to control the capacitance of the capacitor which is created by the electromagnetic field coupling adjustment plate 17 and the conductive base plate 11, by adjusting the area of the electromagnetic field coupling adjustment plate 17 and the distance (interspace) between the electromagnetic field coupling adjustment plate 17 and the conductive base plate 11. This allows for easy impedance matching adjustment.

Figure 2:
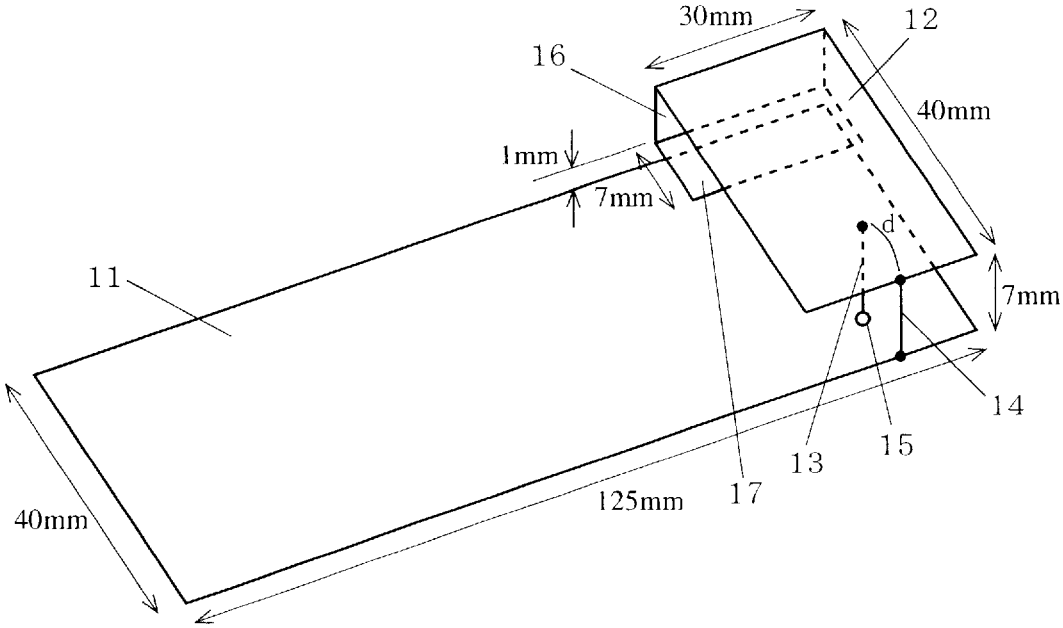
FIG. 2 is it perspective view showing a specific implementation example of the antenna according to the first embodiment of the present invention.
Figure 18:
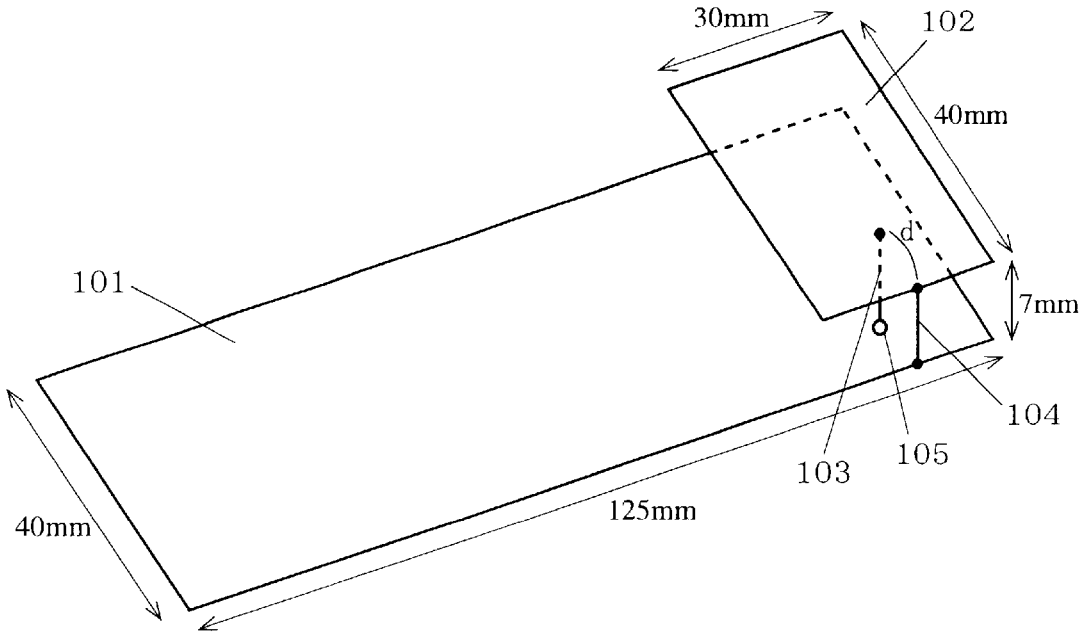
FIG. 18 PRIOR ART
FIG. 18 is a perspective view showing a specific implementation example of the conventional antenna shown in FIG. 16.
Figure 19:
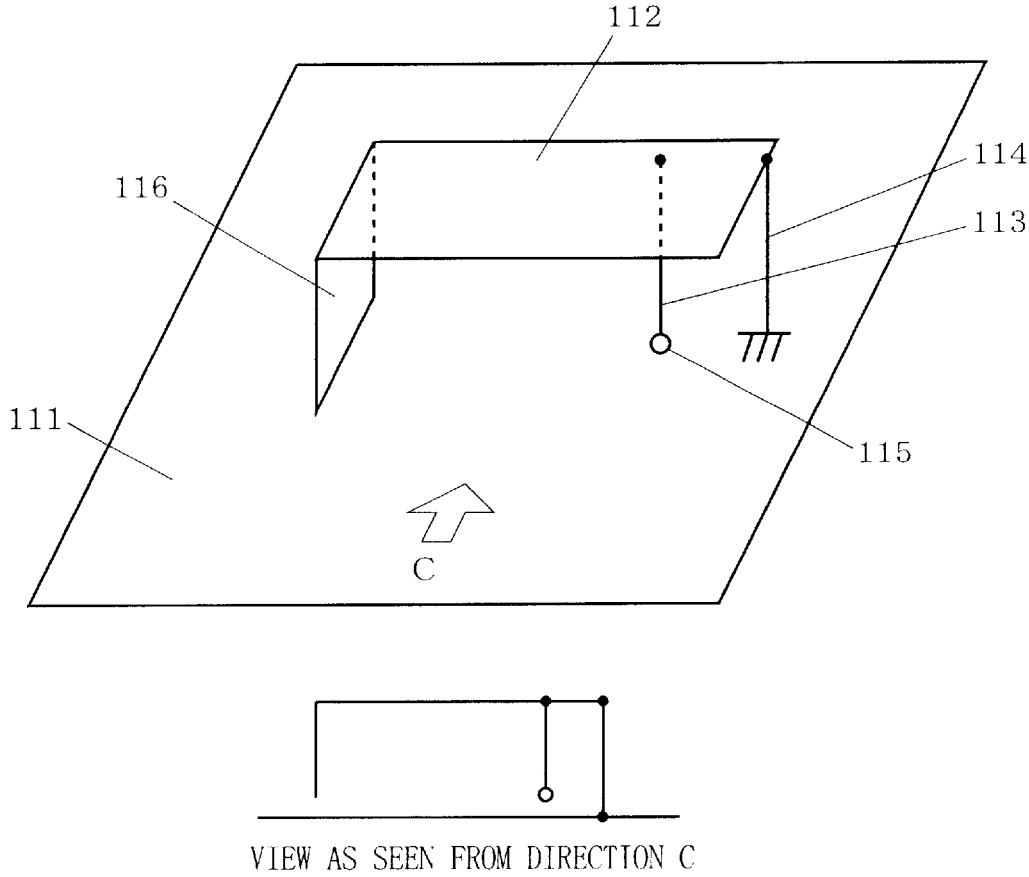
FIG. 19 PRIOR ART
FIG. 19 is a perspective view schematically showing the structure of another conventional antenna.
Figure 20:
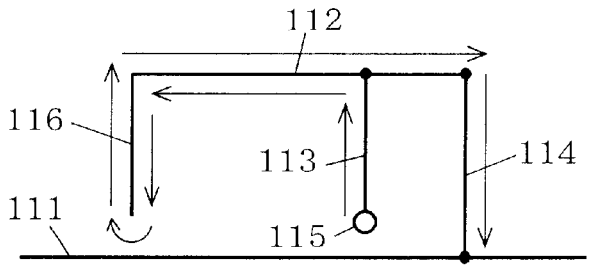
FIG. 20 PRIOR ART
FIG. 20 is a diagram illustrating an exemplary current path which emerges when a voltage from a supply point is applied to the conventional antenna shown in FIG. 19.

FIG. 2 is a perspective views showing a specific implementation example of the antenna according to the first embodiment of the present invention. Note that in FIG. 2, the dimensions of the conductive base plate 11 and the occupied volume of the antenna are the same as those of the conventional structure of FIG. 18. That is, the conductive plate 12 has a rectangular shape with a width of 40 mm and a length of 30 mm. The conductive wall 16 has a rectangular shape with a width of 6 mm and a length of 30 mm. The metal leads 13 and 14 are 7 mm long each.

Figure 21:
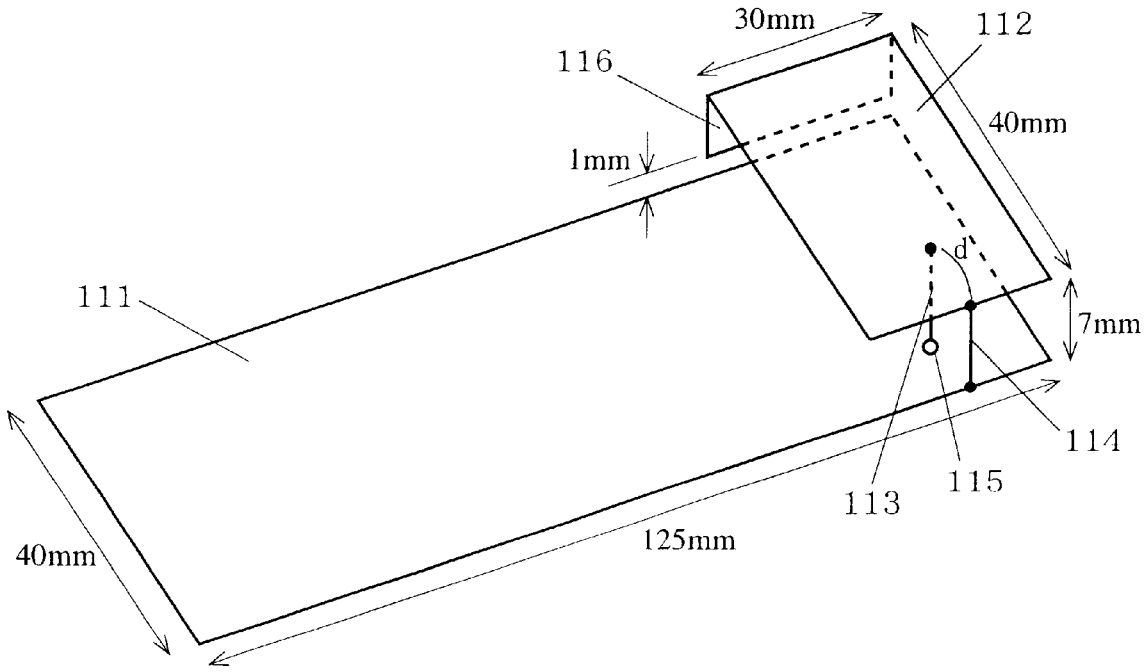
FIG. 21 PRIOR ART
FIG. 21 is a perspective view showing a specific implementation example of the conventional antenna shown in FIG. 19.

If the electromagnetic field coupling adjustment plate 17 has a rectangular shape with a width of 7 mm and a length of 30 mm; then impedance matching is obtained in a 50Ω system under the condition that an interval d between the metal lead 13 (functioning as a supply pin) and the metal lead 14 (functioning as a short-circuiting pin) is 7.5 mm. In this case, the antenna shown in FIG. 2 will have a central frequency of 924 MHz, and the bandwidth under these conditions is 145 MHz. Therefore, a band ratio of this antenna is calculated to be 15.7% (≈145/924). Thus, it can be seen that a lower resonance frequency and more broadband-oriented frequency characteristics are obtained than in the conventional examples shown in FIG. 18 and FIG. 21 above.

The above-described dimensions are only exemplary, and the present invention is not limited thereto.

Figure 16:
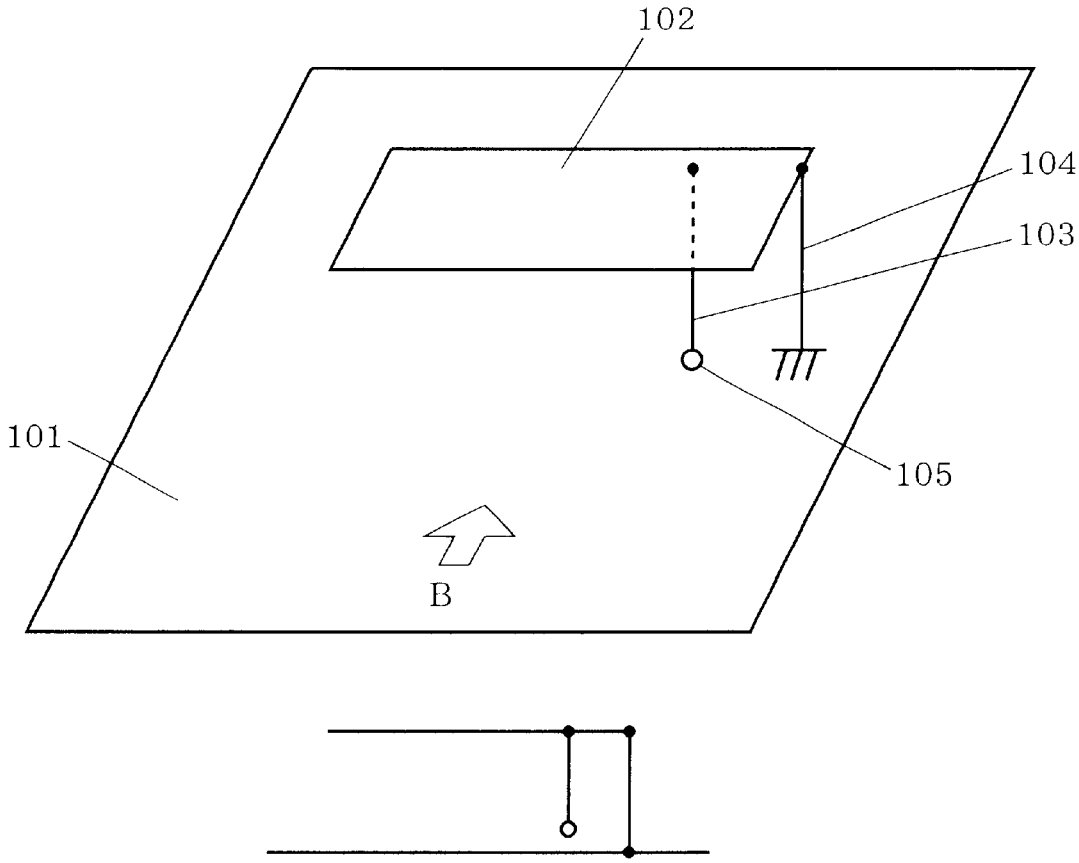
FIG. 16 PRIOR ART
FIG. 16 is a perspective view schematically showing the structure of a conventional antenna.
Figure 17A:
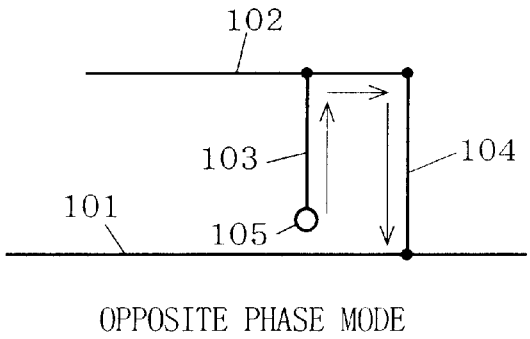
FIG. 17A PRIOR ART
FIGS. 17A and 17B are diagrams illustrating exemplary current paths which emerge when a voltage from a supply point is applied to the conventional antenna shown in FIG. 16.
Figure 17B:
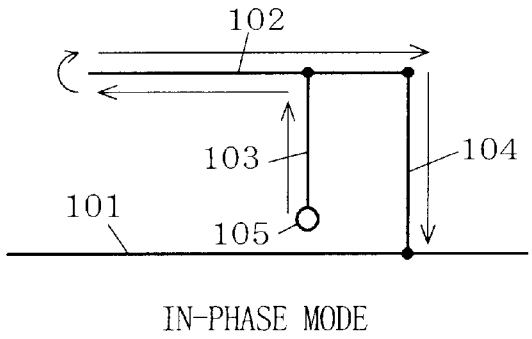
FIG. 17B PRIOR ART

Note that, in the conventional antenna structure shown in FIG. 16, the interval d is the only variable for a given fixed antenna volume, so that the design flexibility is governed by only this variable. Therefore, when the VSWR is optimized for a 50Ω system, the resultant interval d would be as small as 3 mm. Placing the supply pin in such a proximity of the shot-circuiting pin means an increased maximum distance between the supply point and the antenna open end. While this results in a lowered resonance frequency and increased inductance, there is a trade-off in that the band ratio becomes narrower.

In contrast, the antenna structure according to the present invention as shown in FIG. 2 allows not only the interval d, but also the dimensions of the conductive wall 16 and the electromagnetic field coupling adjustment plate 17 to be adjusted, thereby providing increased designing flexibility than in conventional structures. As a result, the antenna structure according to the present invention can provide a lower resonance frequency as well as a broader band ratio than in conventional structures.

Figure 3:
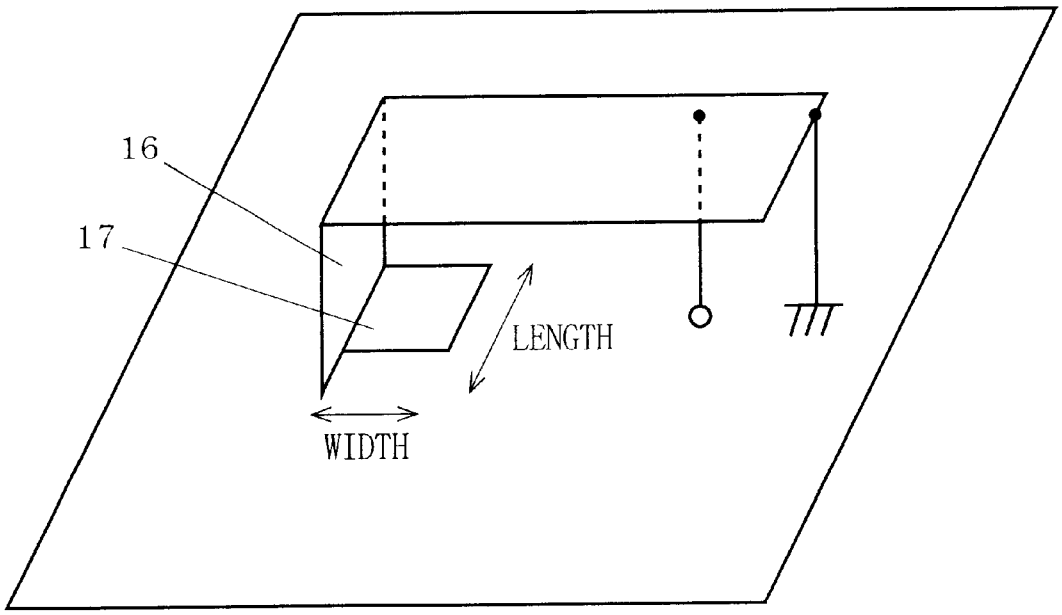
FIG. 3 is a perspective view schematically showing another antenna structure according to the first embodiment of the present invention.

For example, if the width of the electromagnetic field coupling adjustment plate 17 is simply increased in order to further lower the resonance frequency, the area of the electromagnetic field coupling adjustment plate 17 will have a corresponding increase. This results in a stronger capacitive coupling with the conductive base plate 11, which makes impedance matching difficult. In such cases, the length of the electromagnetic field coupling adjustment plate 17 may be decreased in order to reduce the area. Thus, it is possible to adjust the electromagnetic field coupling with the conductive base plate 11 (FIG. 3). Therefore, the length of the conductive wall 16 and the length of the electromagnetic field coupling adjustment plate 17 do not need to be the same.

Second Embodiment

Figure 4:
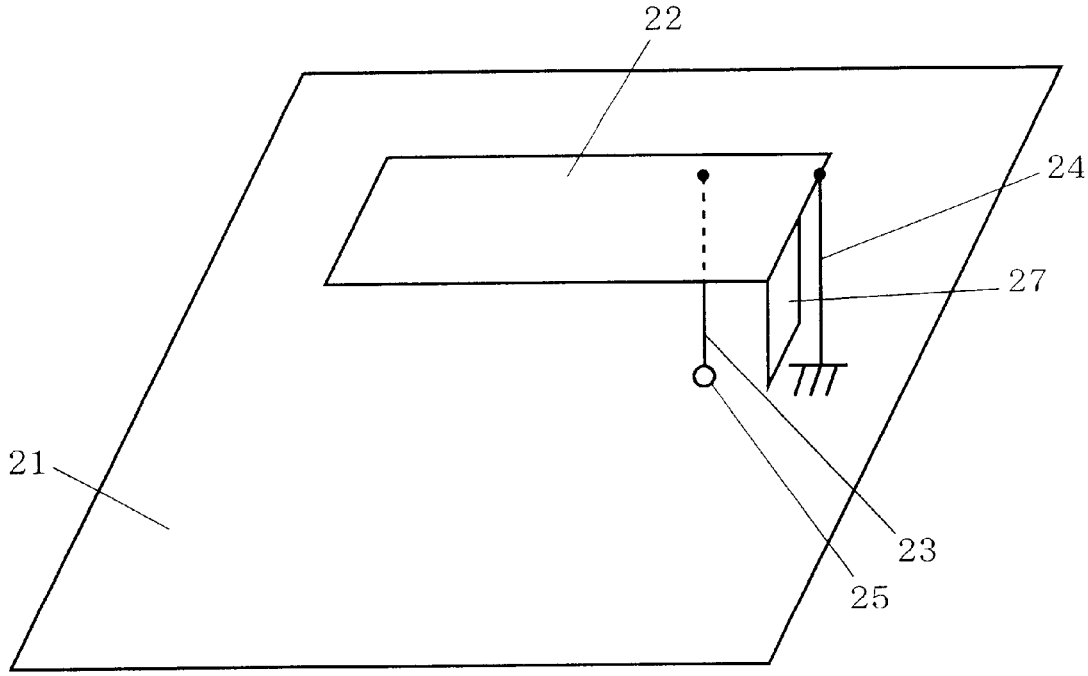
FIG. 4 is a perspective view schematically showing an antenna structure according to a second embodiment of the present invention.

FIG. 4 is a perspective view schematically showing an antenna structure according to a second embodiment of the present invention. As shown in FIG. 4, the antenna according to the second embodiment includes: a conductive base plate 21; a conductive plate 22 having a planar configuration, which defines an antenna sub-element; an electromagnetic field coupling adjustment wall 27, which defines an electromagnetic field coupling adjustment element; and two metal leads 23 and 24. A voltage is applied to the conductive plate 22 from a supply point 25, via the metal lead 23. The conductive plate 22 is coupled to the conductive base plate 21 via the metal lead 24. The electromagnetic field coupling adjustment wall 27 is electrically coupled to the conductive plate 22 at one end thereof.

According to the second embodiment, the electromagnetic field coupling adjustment wall 27 is constructed in such a manner that an interspace is left between the conductive base plate 21 and the end of the electromagnetic field coupling adjustment wall 27 opposite from the end which is electrically coupled to the conductive plate 22. In this case, it is essential for the junction point between the electromagnetic field coupling adjustment wall 27 and the conductive plate 22 to be located in the neighborhood of the metal lead 24. As a result, an electromagnetic field coupling effect is obtained between the electromagnetic field coupling adjustment wall 27 and the metal lead 24.

The first embodiment described above illustrates an arrangement of the electromagnetic field coupling adjustment element (i.e., the conductive wall 16 and the electromagnetic field coupling adjustment plate 17) which provides an increased maximum value of the current path length. In this case, however, the lowering of the antenna resonance frequency occurs with an increase in the capacitive coupling with the conductive base plate 11, so that it is impossible to increase the capacitive coupling while maintaining a constant resonance frequency.

On the other hand, according to the second embodiment, the electromagnetic field coupling adjustment wall 27 is added in a manner which does not increase the maximum value of the current path length, as shown in FIG. 4. As a result, it becomes possible to increase the capacitive coupling with the conductive base plate 21 while maintaining a constant resonance frequency, thereby adding to design flexibility. Moreover, since the neighborhood of the short-circuiting portion has a relatively high current density, which makes impedance matching difficult, the electromagnetic field coupling adjustment wall 27 according to the present embodiment can be effectively employed in the neighborhood of the short-circuiting portion. This reduces the current density in the neighborhood of the short-circuiting portion, and hence, the impedance, thereby facilitating impedance matching.

Figure 5A:
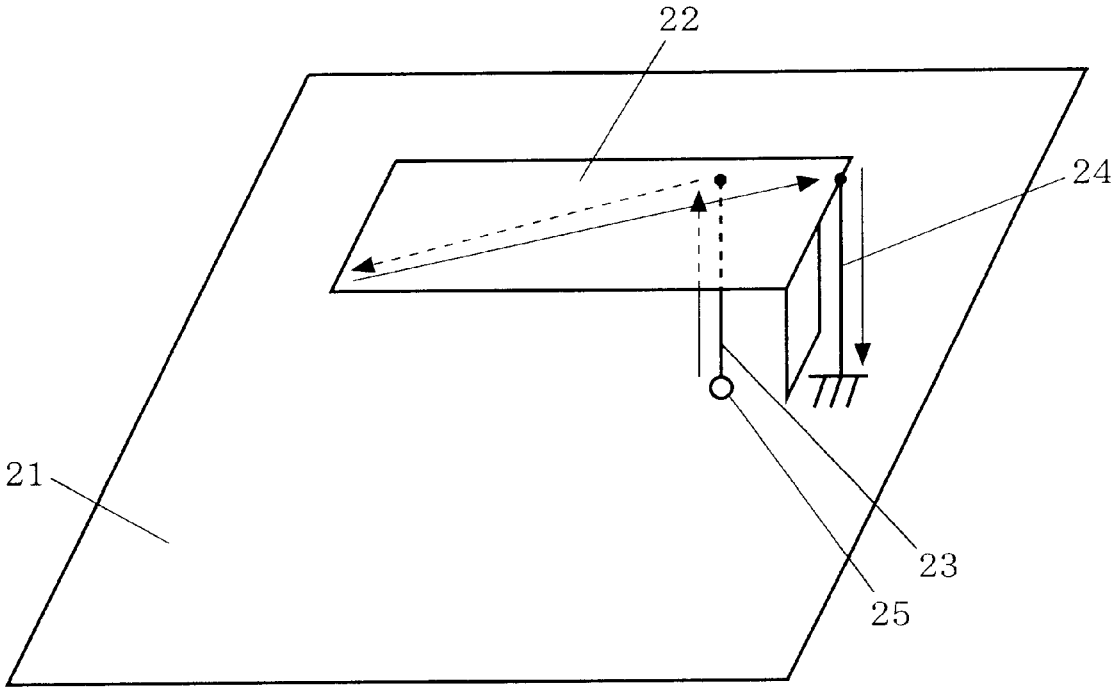
FIGS. 5A and 5B are diagrams illustrating exemplary current paths which emerge when a voltage from a supply point is applied to the antenna shown in FIG. 4.
Figure 5B:
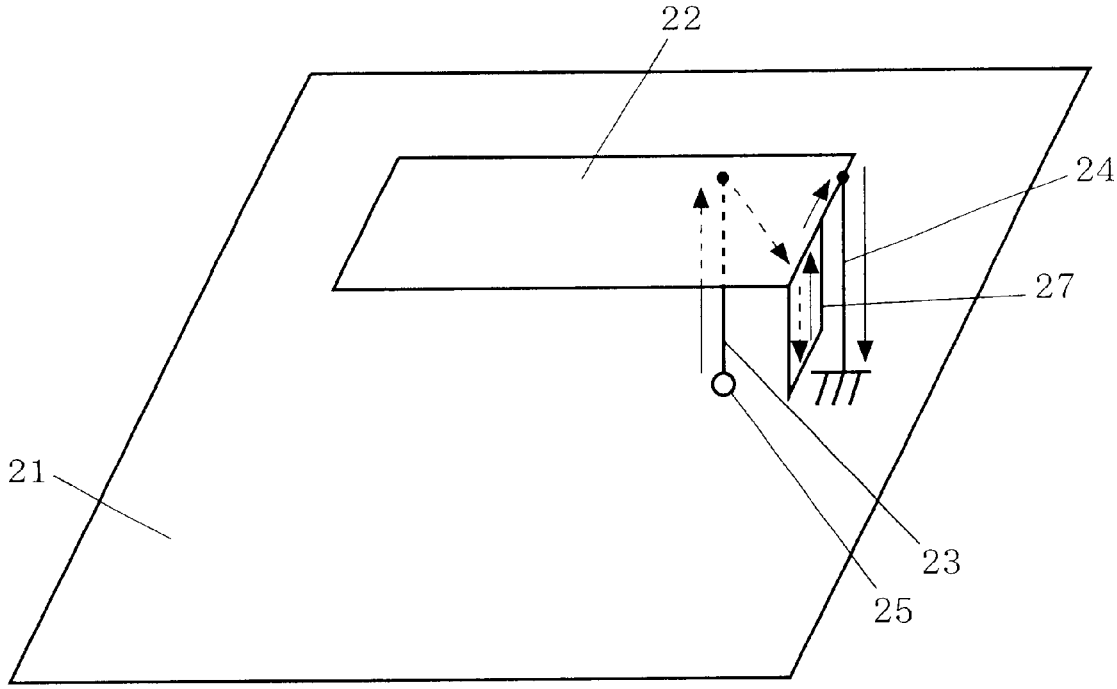
Figure 6A:
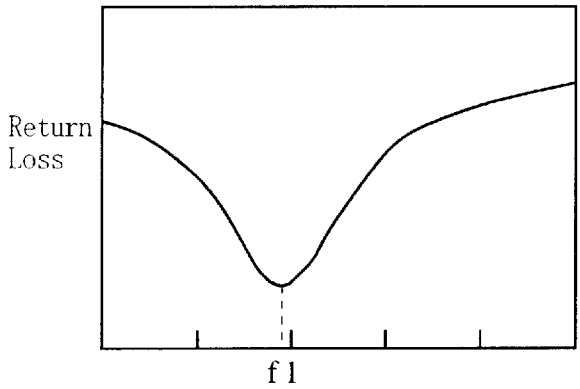
FIGS. 6A, 6B, and 6C show-frequency characteristic patterns illustrating return losses associated with the input impedance for the antenna shown in FIG. 4.
Figure 6B:
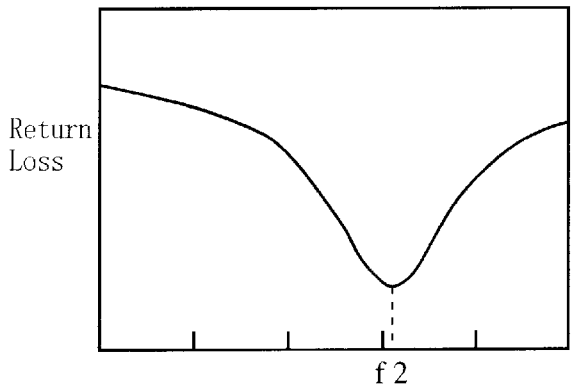

FIGS. 5A and 5B illustrate exemplary current paths which emerge when a voltage from the supply point 25 is applied to the antenna shown in FIG. 4. FIGS. 6A and 6B show the frequency characteristics of return losses associated with the input impedance when viewing the antenna from the standpoint of the supply point 25, respectively corresponding to FIGS. 5A and 5B.

In the structure shown in FIG. 4, current paths in an in-phase mode and/or current paths in an opposite phase mode may emerge when a voltage is applied from the supply point 25. Since currents flowing through a current path in the opposite phase mode will cancel each other so as not to contribute to the resonance of the antenna, only the in-phase mode will be considered.

As shown in FIG. 5A, a current path in the in-phase mode (shown by arrows) begins at the supply point 25, extends through the metal lead 23 and along the lower surface of the conductive plate 22 so as to turn around at the open end, extends along the upper surface of the conductive plate 22 and through the metal lead 24, and arrives at the conductive base plate 21. The currents flowing through the metal leads 23 and 24 are in phase at a frequency at which the length of the current path equals a ½ wavelength, so that the antenna resonates at this frequency. FIG. 6A shows a return loss frequency characteristics pattern of the antenna, where this resonance frequency is indicated as f1.

As shown in FIG. 5B, another current path in the in-phase mode (shown by arrows) begins at the supply point 25, extends through the metal lead 23 and along the lower surface of the conductive plate 22, goes via the junction point between the conductive plate 22 and the electromagnetic field coupling adjustment wall 27 to extend along the inner (lower) surface of the electromagnetic field coupling adjustment wall 27, turns around at the open end of the electromagnetic field coupling adjustment wall 27 to extend along the outer (upper) surface of the electromagnetic field coupling adjustment wall 27, goes via the aforementioned junction point to extend along the upper surface of the conductive plate 22 and through the metal lead 24, and arrives at the conductive base plate 21. Again, the currents flowing through the metal leads 23 and 24 are in phase at a frequency at which the length of the current path equals a ½ wavelength, so that the antenna resonates at this frequency. FIG. 6B shows a return loss frequency characteristics pattern of the antenna, where this resonance frequency is indicated as f2. It will be appreciated that f1 f2 when the current path shown in FIG. 5B is shorter than the current path shown in FIG. 5A.

Figure 6C:
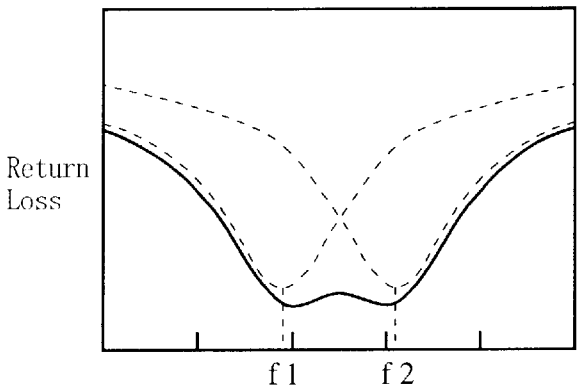

FIG. 6C shows a return loss frequency characteristics pattern of the antenna shown in FIG. 4. This pattern is obtained by superimposing the individual return loss frequency characteristics patterns shown in FIGS. 6A and 6B on each other. Thus, by employing different current path lengths as shown in FIGS. 5A and 5B for causing the antenna to undergo bi-resonance, one can expect to obtain broadband characteristics. The present embodiment is also effective for an antenna for use in a complex-type device which is expected to cover different frequency bands.

Figure 7:
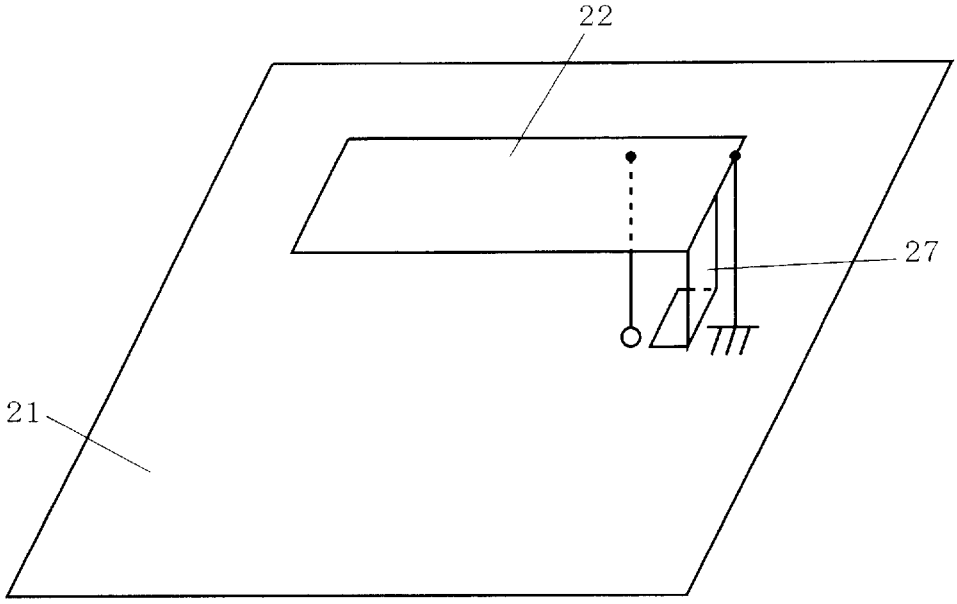
FIG. 7 is a perspective view schematically showing another antenna structure according to the second embodiment of the present invention.

As shown in FIG. 7, the electromagnetic field coupling adjustment wall 27 may be provided with a portion which is bent so as to extend in parallel to the conductive base plate 21 (i.e., with an additional electromagnetic field coupling adjustment plate), thereby providing a stronger electromagnetic field coupling with the conductive base plate 21. In such cases, it will be appreciated that the electromagnetic field coupling with the conductive base plate 21 can be controlled by adjusting the dimensions of the bent portion of the electromagnetic field coupling adjustment wall 27, whereby impedance matching is facilitated.

Third Embodiment

Figure 8:
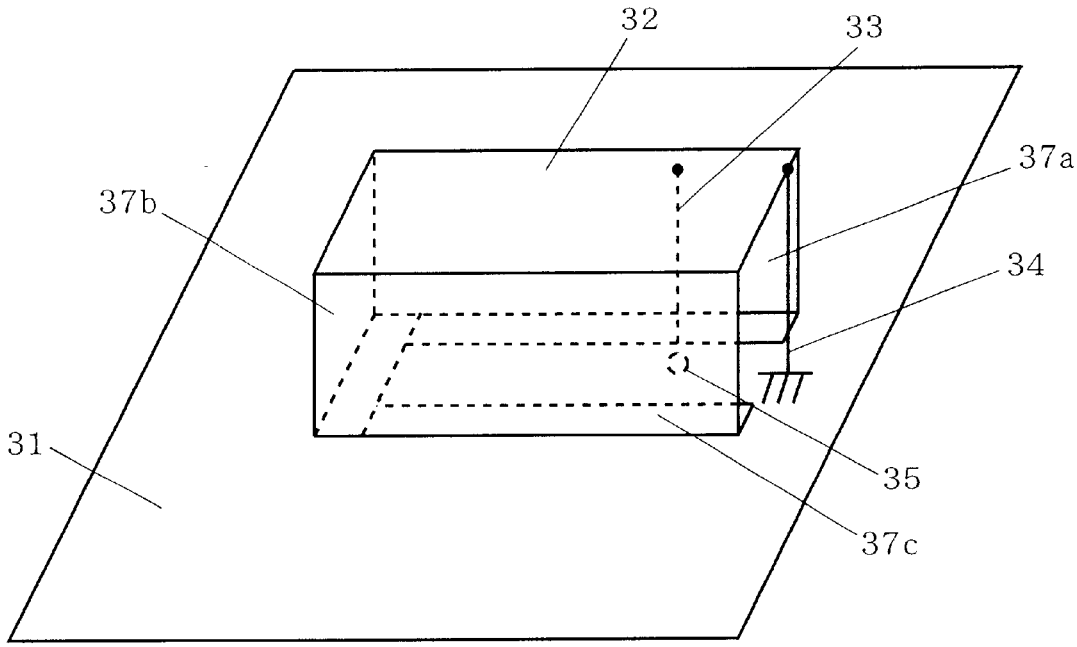
FIG. 8 is a perspective view schematically showing an antenna structure according to a third embodiment of the present invention.

FIG. 8 is a perspective view schematically showing an antenna structure according to a third embodiment of the present invention. As shown in FIG. 8, the antenna according to the third embodiment includes: a conductive base plate 31; a conductive plate 32 having a planar configuration, which defines an antenna sub-element; L-shaped conductive walls 37*a*, 37*b*, and 37*c*, which together define an electromagnetic field coupling adjustment element; and two metal leads 33 and 34. A voltage is applied to the conductive plate 32 from a supply point 35, via the metal lead 33. The conductive plate 32 is coupled to the conductive base plate 31 via the metal lead 34. The three L-shaped conductive walls 37*a* to 37*c* are each electrically coupled to the conductive plate 32 at one end thereof In the third embodiment, the bent portion of each of the three L-shaped conductive walls 37*a* to 37*c* (which together define an electromagnetic field coupling adjustment element) is disposed so as to leave a predetermined interspace between itself and the conductive base plate 31, thereby creating a capacitor in conjunction with the conductive base plate 31.

Based on this structure, by adjusting the areas of the L-shaped conductive walls 37*a* to 37*c* and the distances (interspaces) between the respective bent portions and the conductive base plate 31, it is possible to flexibly control the capacitances of the capacitors which are created by the L-shaped conductive walls 37*a* to 37*c* and the conductive base plate 31, whereby impedance matching is facilitated.

Figure 9:
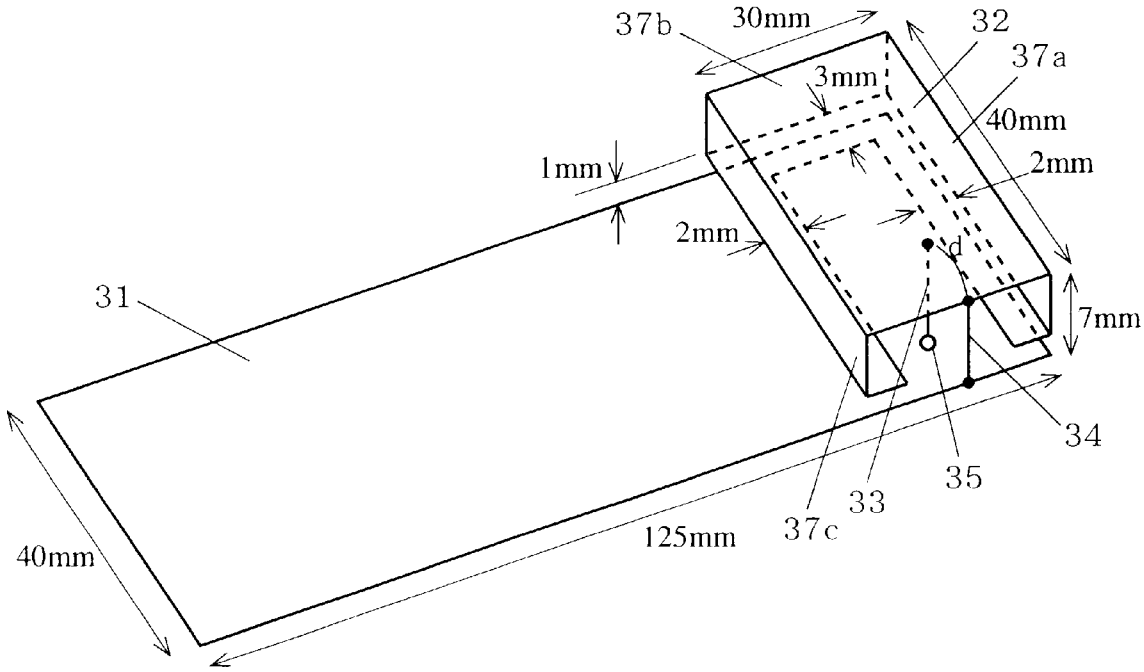
FIG. 9 is a perspective view showing a specific implementation example of the antenna according to the third embodiment of the present invention.

FIG. 9 is a perspective view showing a specific implementation example of the antenna according to the third embodiment of the present invention. Note that in FIG. 9, the dimensions of the conductive base plate 31 and the occupied volume of the antenna are the same as those of the conventional structure of FIG. 18. That is, the conductive plate 32 has a rectangular shape with a width of 40 mm and a length of 30 mm. The metal leads 33 and 34 are 7 mm long each. The L-shaped conductive walls 37*a* and 37*c* are connected to the respective longitudinal sides of the conductive plate 32. The L-shaped conductive wall 37*b* is connected to one of the shorter sides of the conductive plate 32. One end of the metal lead 34 is coupled to the other shorter side of the conductive plate 32. The other end of the metal lead 34 is connected to the conductive base plate 31. The supply point 35 is coupled to the conductive plate 32 via the metal lead 33. The L-shaped conductive walls 37*a* and 37*c* are dimensioned so that their wall portions each have a rectangular shape with a width of 40 mm and a length of 6 mm, the bent portions being 2 mm long each. The L-shaped conductive wall 37*b* is dimensioned so that its wall portion has a rectangular shape with a length of 30 mm and a width of 6 mm, the bent portion being 3 mm wide.

If the interval d between the metal leads 33 and 34 is 7.5 mm, the antenna shown in FIG. 9 will have a central frequency of 949 MHz in the case of a 50Ω system, with a bandwidth of 236 MHz. Accordingly, the band ratio of this antenna is calculated to be 24.9% (≈236/949). Thus, it can be seen that a lower resonance frequency and more broadband-oriented frequency characteristics are obtained than in the conventional examples shown in FIG. 18 and FIG. 21 above.

Figure 10:
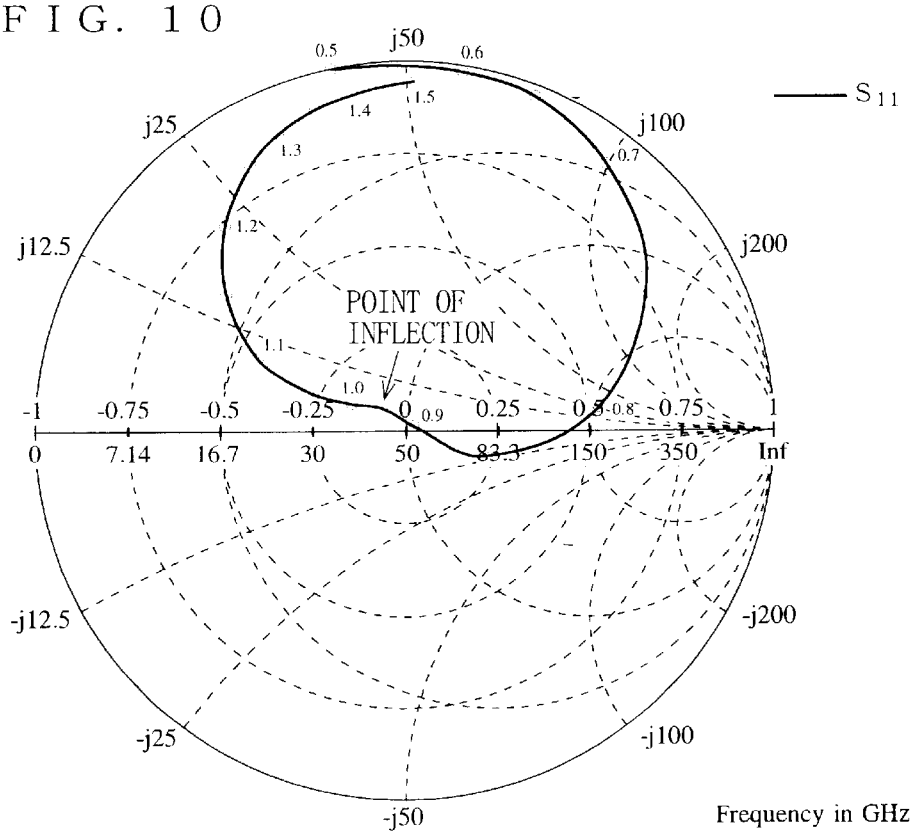
FIG. 10 is a Smith chart showing $S_{11}$ of the antenna structure of FIG. 9.

FIG. 10 is a Smith chart showing $S_{11}$ of the antenna structure of FIG. 9. It can be seen from FIG. 10 that a point of inflection exists in the vicinity of 950 MHz, indicative of the bi-resonance operation of the antenna. The bi-resonance is considered to be a result of the slight difference between the resonance frequency of the antenna and the resonance frequency of the conductive base plate 31. It can be determined from FIG. 10 that a band ratio of 24.9% is present due to the bi-resonance.

Figure 11:
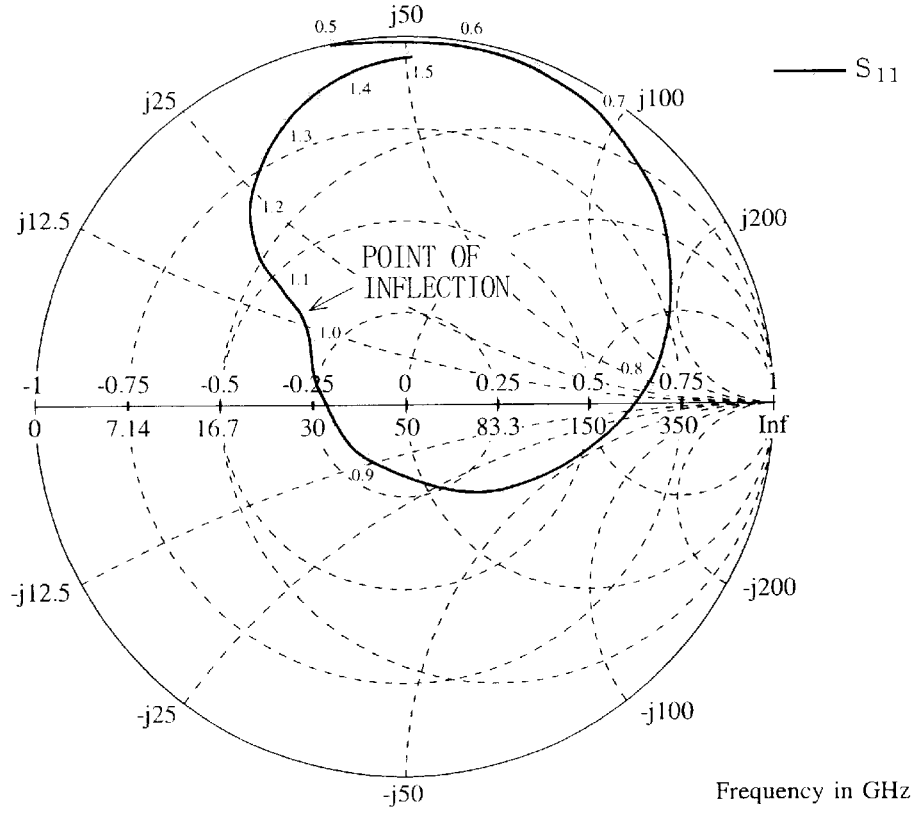
FIG. 11 is a Smith chart showing $S_{11}$ of the antenna structure of FIG. 9, where the length of the conductive base plate is altered.

FIG. 11 is a Smith chart showing $S_{11}$ of the antenna structure of FIG. 9, where the length of the conductive base plate 31 is changed to 115 mm. No other parameters are changed from FIG. 9. From FIG. 11, it can be seen that the point of inflection has shifted to 1.05 GHz. This is because of an increased resonance frequency of the conductive base plate 31, which in turn is due to the shorter length of the conductive base plate 31. In this case, the central frequency is 934 MHz and the bandwidth is 158 MHz. Therefore, the band ratio of this antenna is calculated to be 16.9% (≈158/934).

Figure 12:
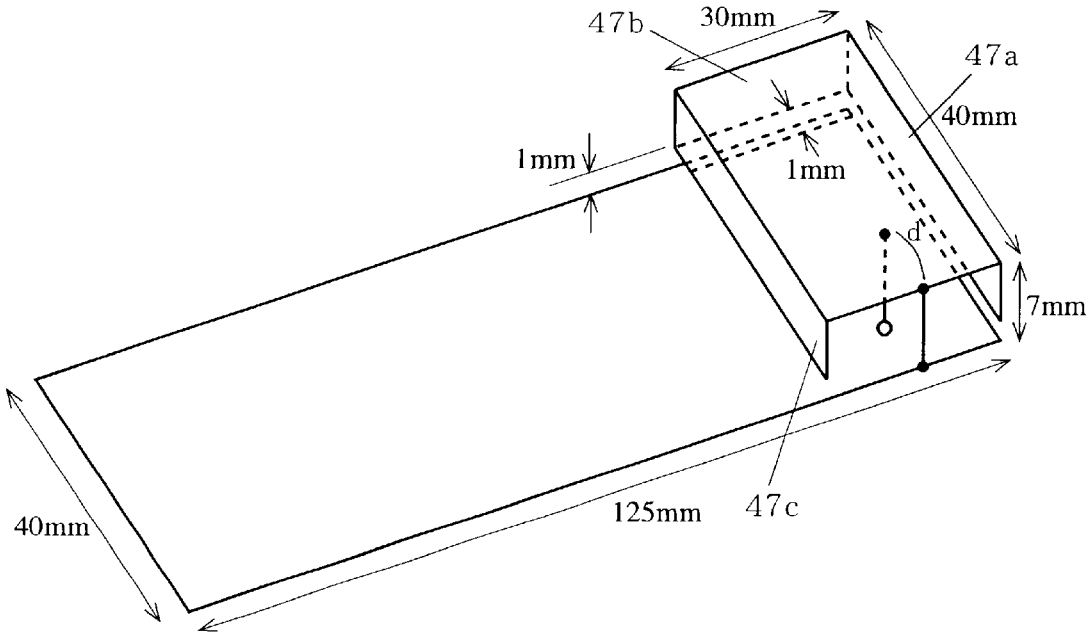
FIG. 12 is a perspective view schematically showing another antenna structure according to the third embodiment of the present invention.

Accordingly, the dimensions of the antenna may be readjusted as shown in FIG. 12. In FIG. 12, the electromagnetic field coupling adjustment element is composed of an electromagnetic field coupling adjustment wall 47*a*, an electromagnetic field coupling adjustment wall 47*c*, and an L-shaped electromagnetic field coupling adjustment wall 47*b*. The electromagnetic field coupling adjustment wall 47*a* and 47*c* each have a rectangular shape with a width of 40 mm and a length of 6 mm. The L-shaped electromagnetic field coupling adjustment wall 47*b* is dimensioned so that its wall portion has a rectangular shape with a length of 30 mm and a width of 6 mm, with the bent portion being 1 mm wide.

Figure 13:
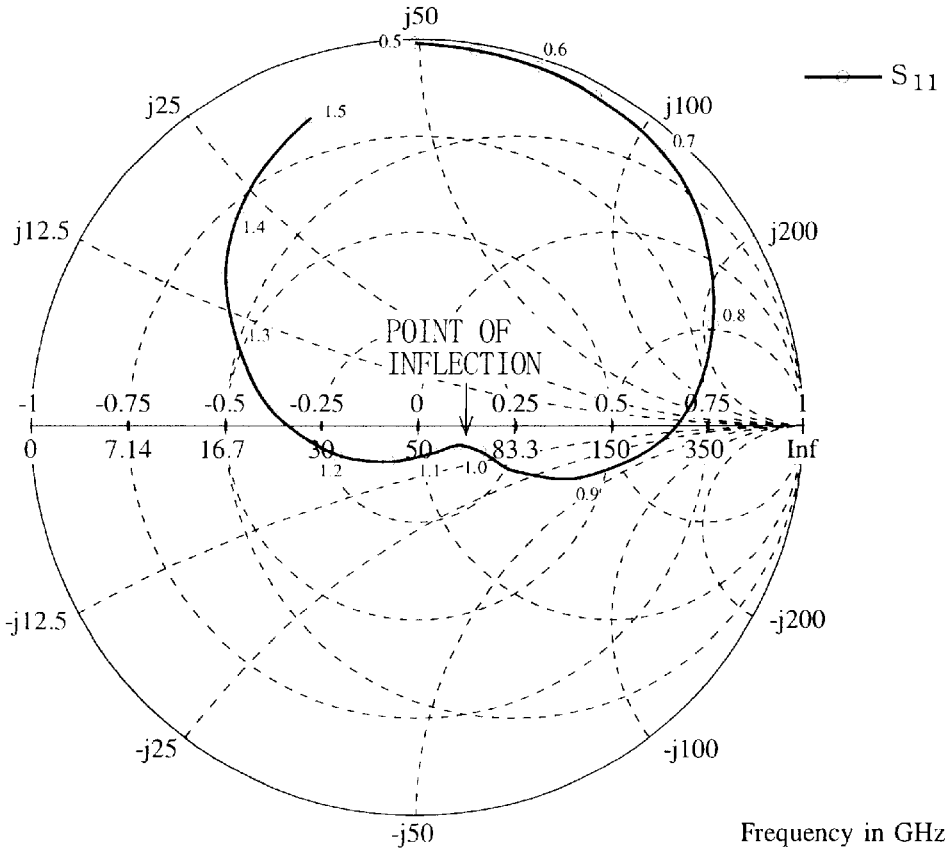
FIG. 13 is a Smith chart showing $S_{11}$ of the antenna structure of FIG. 12.

If the interval d between the metal leads 33 and 34 is 12.5mm, the antenna shown in FIG. 12 will have a central frequency of 1084 MHz in the case of a 50Ω system, with a bandwidth of 306 MHz. Accordingly, the band ratio of this antenna is calculated to be 28.2% (≈306/1084). FIG. 13 is a Smith chart showing $S_{11}$ of the antenna structure of FIG. 12. From FIG. 13, it can be seen that a point of inflection exists in the vicinity of 1.05 GHz near the center of the Smith chart.

As described above, in each of the antenna structures according to the first to third embodiments of the present invention, an antenna element is designed in a characteristic shape having an electromagnetic field coupling adjustment element, so as to utilize electromagnetic field coupling with the conductive base plate. By adjusting the electromagnetic field coupling between the antenna and the conductive base plate through the adjustment of the dimensions of the electromagnetic field coupling adjustment element as parameters, it is possible to obtain a slight difference between the resonance frequency of the antenna and the resonance frequency of the conductive base plate, thereby providing broadband frequency characteristics. Moreover, the ability to produce a lowered resonance frequency also enables antenna downsizing without compromising broadband impedance characteristics. Since an increased number of design parameters is introduced, impedance matching is facilitated.

Figure 14A:
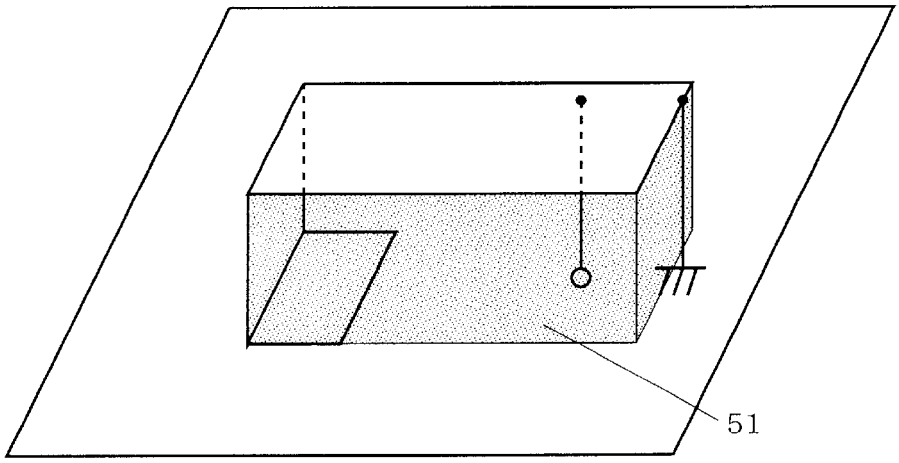
FIGS. 14A, 14B, and 14C are perspective views schematically showing other antenna structures according to the first to third embodiments of the present invention.

It will be appreciated that further downsizing of the antennas can be achieved in the above-described embodiments by filling all or part of the space surrounded by the conductive plate, the electromagnetic field coupling adjustment element, and the conductive base plate with a dielectric material 51 (e.g., as shown in FIG. 14A).

Figure 14B:
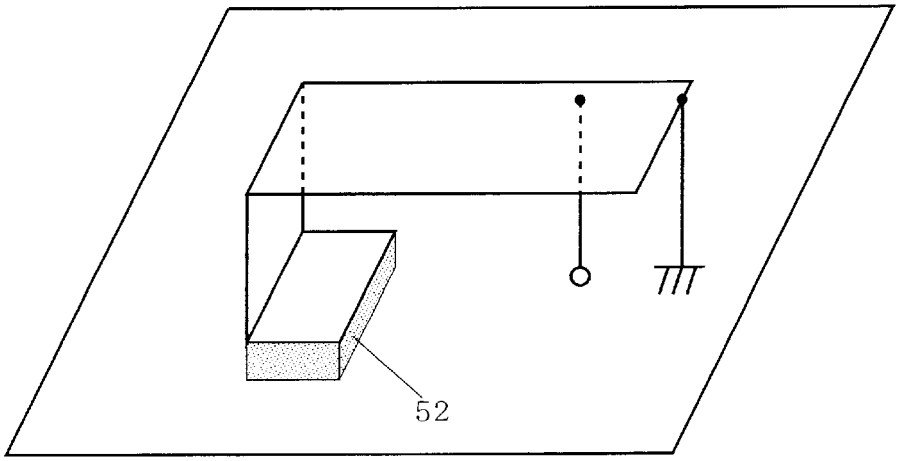

Alternatively, the electromagnetic field coupling adjustment element may be fixed on the conductive base plate by means of a support base 52 composed of a dielectric material (e.g., as shown in FIG. 14B). As a result, a higher level of capacitive coupling between the electromagnetic field coupling adjustment element and the conductive base plate can be expected, while being able to stabilize the antenna element provided on the conductive base plate. This also makes it possible to accurately control the distance between the electromagnetic field coupling adjustment element and the conductive base plate, so that an improved mass-productivity can be expected.

Figure 14C:
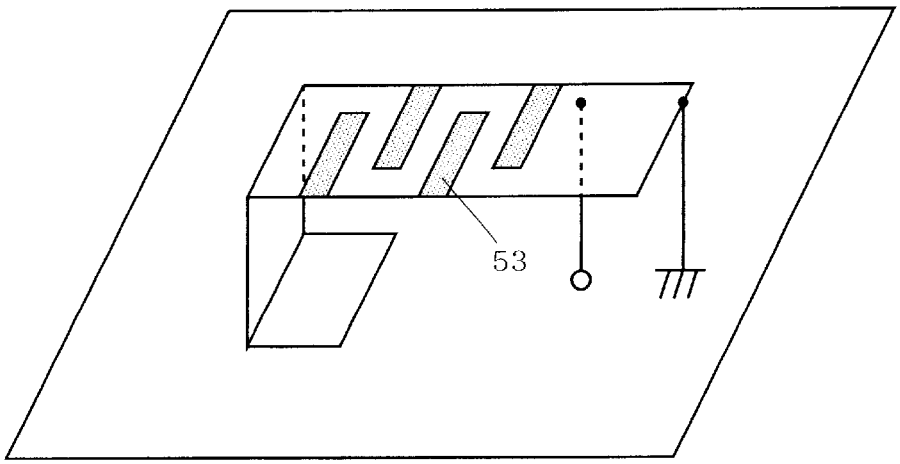

Slits 53 may be provided in at least either of the conductive plate or the electromagnetic field coupling adjustment element (e.g., FIG. 14C). As a result, the resonance frequency can be lowered, and further antenna downsizing can be expected. In this case, a substantial decrease in the resonance frequency can be obtained by providing slits in regions associated with intense current distributions. It will be appreciated that providing slits in the electromagnetic field coupling adjustment element also helps controlling the capacitance created in conjunction with the conductive base plate.

In the case of wireless devices such as mobile phone terminals, the dimensions of the conductive base plate are generally smaller than the wavelength used. Since the conductive base plate is also considered to be contributing to the radiowave radiation as an antenna in this case, it is necessary to take into account the effects of the conductive base plate when designing the antenna. Note that exemplary lengths and widths for the conductive base plate are given in the above embodiments. When the size of the conductive base plate is changed, one can still easily attain impedance matching by controlling the electromagnetic field coupling with the conductive base plate through the adjustment of the area of the electromagnetic field coupling adjustment element and the distance from the conductive base plate.

Although the above embodiments illustrate structures in which the short-circuiting pin and the supply pin are arrayed in a (width) direction running lateral to the longitudinal direction of the conductive base plate, the present invention is not limited thereto. In the case where the short-circuiting pin and the supply pin are in a lateral array, the current path generally extends in a lateral direction so that horizontal polarization components are increased. Since a mobile phone terminal is likely to be used at a relatively low elevation angle of about 30 during calls, the horizontal polarization components are converted to vertical polarization. In the case of currently-used digital mobile phones (PDC: Personal Digital Cellular), for which a cross polarization discrimination of about 6 dB would be available in town, vertical polarization is more advantageous. Thus, by employing a lateral array of a short-circuiting pin and a supply pin as described in the above embodiments, a strong emission of vertical polarization components can be expected during calls.

In the above embodiments, a short-circuiting pin and a supply pin may be located at an upper end of the conductive plate along the longitudinal direction of the conductive base plate so as to increase the maximum value of the current path, whereby further downsizing of the antenna can be attained. Note that the "upper end" of the conductive plate may be either end along the length dimension of the conductive plate because the conductive plate may be positioned at the opposite end of the conductive base plate from where it is shown in each figure. This is advantageous in the case of employing a relatively small conductive base plate because the maximum value of the current path upon the conductive base plate can be effectively increased. Since the short-circuiting pin and the supply pin—which are the maximal points of current distribution—are located at the upper end of the conductive base plate, it is possible to ensure that a person's hand which is holding the mobile phone terminal is at a distance from the short-circuiting pin and the supply pin. This is effective for preventing deterioration in the device characteristics.

Although the above embodiments illustrate structures featuring one short-circuiting pin, the present invention is not limited thereto. It will be appreciated that two or more short-circuiting pins, or no short-circuiting pins at all, may alternatively be employed. Note, however, that a structure incorporating no short-circuiting pins embodies a $\lambda/2$ resonance system, which is not suitable for antenna downsizing.

Although the conductive plate and the electromagnetic field coupling adjustment element in each of the above embodiments are illustrated as discrete components of the antenna element, they may be formed integrally of one piece of conductive material which is bent through sheet metal processing. By employing such an integrally-formed antenna element, the mechanical strength of the antenna and the mass productivity of the antenna products can be enhanced.

It will be appreciated that two implementations of the antenna described in each embodiment may be arrayed on a conductive base plate, with voltages being supplied thereto in opposite phases. In this case, not only the aforementioned effects are obtained, but it is also possible to concentrate currents flowing on the conductive base plate in the neighborhood of the antenna element. As a result, the device characteristics can be prevented from deteriorating when a device incorporating the antenna is held in one's hand. By arranging the electromagnetic field coupling adjustment element so that the resonance frequencies of the two antennas are slightly different, more broadband-oriented characteristics can be expected.

Although the first to third embodiments illustrate antenna structures having a single resonance frequency band, it is also possible to realize an antenna structure having two resonance frequency bands in one of the following manners.

1. Structures for Selectively Supporting One of the Two Resonance Frequency Bands.

Figure 15A:
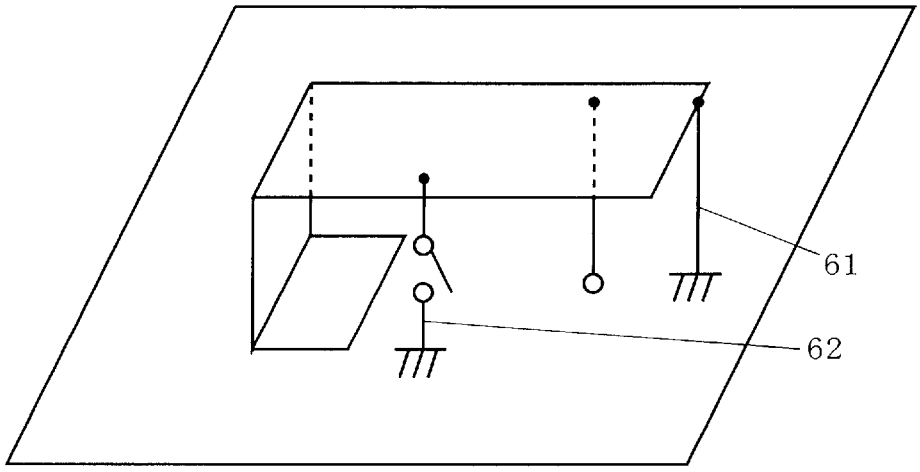
FIGS. 15A, 15B, and 15C ate perspective views schematically showing variants of the antennas according to the first to third embodiments of the present invention, where two resonance frequency bands are supported by a single antenna.

As shown in FIG. 15A, for example, this type of antenna structure can be realized by providing on the antenna element a short-circuiting connection member (a metal lead 61) for a first resonance frequency band and a short-circuiting connection member (metal lead 62) for a second resonance frequency band. By selectively controlling the conduction of the two short-circuiting connection members, it becomes possible to effectuate either the first or the second resonance frequency band. This type of antenna structure can also be realized by providing on the antenna element two supply connection members that are selectively switchable.

2. Structures for Supporting Two Resonance Frequency Bands at the Same Time.

Figure 15B:
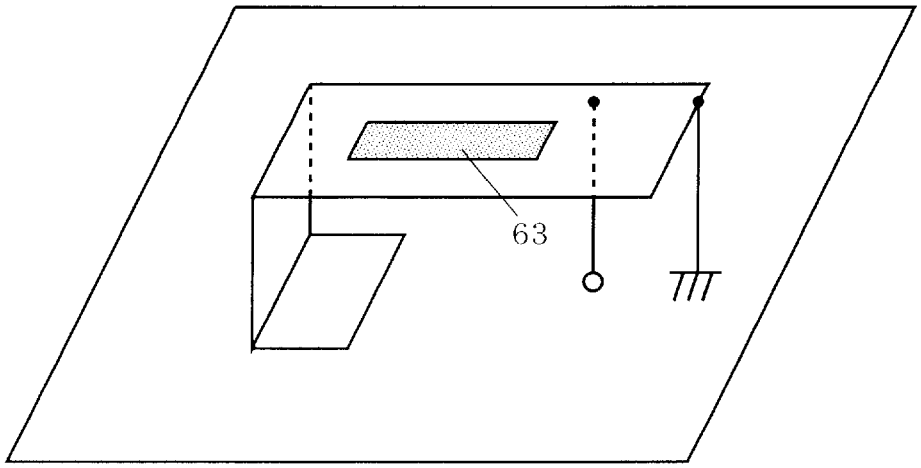
Figure 15C:
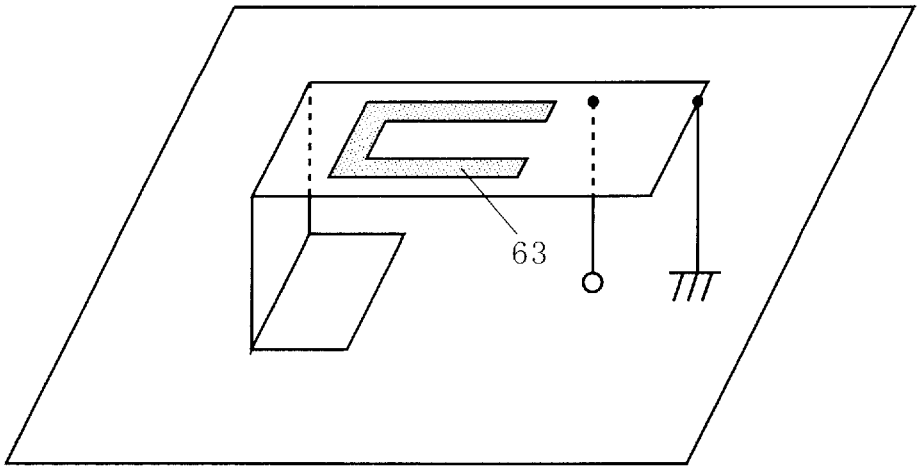

As shown in FIG. 15B or 15C, for example, this type of antenna structure can be realized by providing a slot 63 in the antenna element. The entire antenna element supports a first resonance frequency band, while the slotted portion supports a second resonance frequency band. Thus, an antenna structure which simultaneously supports two resonance frequency bands can be realized.

Although the above examples illustrate a single antenna structure for selectively or simultaneously supporting two resonance frequency bands, an antenna structure for selectively or simultaneously supporting three or more resonance frequency bands can also be realized in similar manners. It will be appreciated that two implementations of such an antenna structure for selectively or simultaneously supporting a plurality of resonance frequency bands may be arrayed on a conductive base plate, with voltages being supplied thereto in opposite phases.

While the invention has been described in detail, the foregoing description is in all aspects illustrative and not restrictive. It is understood that numerous other modifications and variations can be devised without departing from the scope of the invention.

What is claimed is:

1. An antenna for use in a wireless device, said antenna comprising:

a conductive base plate for providing a ground level;

an antenna sub-element disposed on said conductive base plate;

a supply connection member for applying a predetermined voltage to said antenna sub-element;

at least one short-circuiting connection member for short-circuiting said antenna sub-element to said conductive base plate; and an electromagnetic field coupling adjustment element having an end electrically coupled to said antenna sub-element, wherein said electromagnetic field coupling adjustment element has a predetermined interspace with respect to at least one of said conductive base plate and said at least one short-circuiting connection member and extends in a direction generally parallel to said at least one of said conductive base plate and said at least one short-circuiting connection member, so as to produce an electromagnetic field coupling effect in conjunction with said at least one of said conductive base plate and said at least one short-circuiting connection member, without increasing a maximum value of a current path length, and wherein a length from a junction of said supply connection member and said antenna sub-element to an open end of said antenna sub-element along said antenna sub-element is greater than or equal to a length from the junction-to an open end of said electromagnetic field coupling adjustment element along a portion of said antenna sub-element between said supply connection member and said electromagnetic field coupling adjustment element and said electromagnetic field coupling adjustment element.

2. An antenna according to claim 1, wherein said electromagnetic field coupling adjustment element has a predetermined planar region extending from an open end of said electromagnetic field coupling adjustment element opposite from said end of said electromagnetic field coupling adjustment element, said predetermined planar region having a predetermined interspace with respect to said conductive base plate and extending, in a direction generally parallel to said conductive base plate, toward an interspace between said antenna sub-element and said conductive base plate, so as to produce an electromagnetic field coupling effect in conjunction with said conductive base plate.

3. An antenna according to claim 2, further comprising a dielectric material filling at least a portion of a space surrounded by said antenna sub-element, said electromagnetic field coupling adjustment element, and said conductive base plate.

4. An antenna according to claim 2, further comprising a support base comprising a dielectric material, wherein said electromagnetic field coupling adjustment element is fixed to said conductive base plate via said support base.

5. An antenna according to claim 2, wherein at least one of said antenna sub-element and said electromagnetic field coupling adjustment element has a slit for elongating a path from said supply connection member to said short-circuiting connection member.

6. An antenna according to claim 2, wherein said electromagnetic field coupling adjustment element and said antenna sub-element are one integral piece formed through bending.

7. An antenna device comprising a common conductive base plate and two implementations of said antenna as recited in claim 2, disposed on said common conductive base plate, wherein predetermined voltages are applied to said two implementations of said antenna with a phase difference of about 180 degrees.

8. A wireless device comprising said antenna as recited in claim 2.

9. An antenna according to claim 1, wherein at least one of said antenna sub-element and said electromagnetic field coupling adjustment element has a slit for elongating a path from said supply connection member to said short-circuiting connection member.

10. An antenna according to claim 1, wherein said antenna resonates with at least two frequencies.

11. An antenna according to claim 10, wherein said at least one short-circuiting connection member is a plurality of said short-circuiting connection members which are specific to respectively different resonance frequency bands, and one of the resonance frequency bands is selectively supported by controlling conduction of said plurality of short-circuiting connection members.

12. An antenna according to claim 10, further comprising at least one additional supply connection member, wherein said supply connection member and said at least one additional supply connection member form a plurality of supply connection members which are specific to respectively different resonance frequency bands, and one of the resonance frequency bands is selectively supported by controlling conduction of said plurality of supply connection members.

13. An antenna according to claim 10, wherein said at least one short-circuiting connection member is specific to a first resonance frequency band, said antenna further comprises a slot specific to a second resonance frequency band, and the first and second resonance frequency bards are simultaneously supported based on an action of said antenna sub-element and the slot.

14. An antenna device comprising a common conductive base plate and two implementations of said antenna as recited in claim 1, disposed on said common conductive base plate, wherein predetermined voltages are applied to said two implementations of said antenna with a phase difference of about 180 degrees.

15. A wireless device comprising said antenna as recited in claim 1.

16. An antenna for use in a wireless device, said antenna comprising:

a conductive base plate for providing a ground level;

an antenna sub-element disposed on said conductive base plate;

a supply connection member for applying a predetermined voltage to said antenna sub-element;

at least one short-circuiting connection member for short-circuiting said antenna sub-element to said conductive base plate; and an electromagnetic field coupling adjustment element having an end electrically coupled to said antenna sub-element, wherein a portion of said electromagnetic field coupling adjustment element has a predetermined planar region having a predetermined interspace with respect to said conductive base plate, said predetermined planar region extending from an open end of said electromagnetic field coupling adjustment element opposite to said end electrically coupled to said antenna sub-element in a direction generally parallel to said conductive base plate toward an interspace between said antenna sub-element and said conductive base plate, so as to increase a maximum value of a current path length and produce an electromagnetic field coupling effect in conjunction with said conductive base plate, and wherein another portion of said electromagnetic field coupling adjustment element has a predetermined interspace with respect to at least one of said conductive base plate and said at least one short-circuiting connection member and extends in a direction generally parallel to said at least one of said conductive base plate and said at least one short-circuiting connection member, so as to produce an electromagnetic field coupling effect in conjunction with said at least one of said conductive base plate and said at least one short-circuiting connection member, without increasing the maximum value of the current path length, and wherein a length from a junction of said supply connection member and said antenna sub-element to an open end of said antenna sub-element along said antenna sub-element is greater than or equal to a length from the junction to an open end of said electromagnetic field coupling adjustment element along a portion of said antenna sub-element between said supply connection member and said electromagnetic field coupling adjustment element and said electromagnetic field coupling adjustment element.

17. An antenna according to claim 16, further comprising a dielectric material filling at least a portion of a space surrounded by said antenna sub-element, said electromagnetic field coupling adjustment element, and said conductive base plate.

18. An antenna according to claim 16, further comprising a support base comprising a dielectric material, wherein said electromagnetic field coupling adjustment element is fixed to said conductive base plate via said support base.

19. An antenna according to claim 16, wherein at least one of said antenna sub-element and said electromagnetic field coupling adjustment element has a slit for elongating a path from said supply connection member to said short-circuiting connection member.

20. An antenna according to claim 16, wherein said electromagnetic field coupling adjustment element and said antenna sub-element are one integral piece formed through bending.

21. An antenna according to claim 16, wherein said antenna resonates with at least two frequencies.

22. An antenna according to claim 21, wherein said at least one short-circuiting connection member is a plurality of said short-circuiting connection members which are specific to respectively different resonance frequency bands, and one of the resonance frequency bands is selectively supported by controlling conduction of said plurality of short-circuiting connection members.

23. An antenna according to claim 21, further comprising at least one additional supply connection member, wherein said supply connection member and said at least one additional supply connection member form a plurality of supply connection members which are specific to respectively different resonance frequency bands, and one of the resonance frequency bands is selectively supported by controlling conduction of said plurality of supply connection members.

24. An antenna according to claim 21, wherein said at least one short-circuiting connection member is specific to a first resonance frequency band, said antenna further comprises a slot specific to a second resonance frequency band, and the first and second resonance frequency bands are simultaneously supported based on an action of said antenna sub-element and the slot.

25. An antenna device comprising a common conductive base plate and two implementations of said antenna as recited in claim 16 disposed on said common conductive base plate, wherein predetermined voltages are applied to said two implementations of said antenna with a phase difference of about 180 degrees.

26. A wireless device comprising said antenna as recited in claim 16.

* * * * *

UNITED STATES PATENT AND TRADEMARK OFFICE

CERTIFICATE OF CORRECTION

PATENT NO. : 6,633,261 B2
DATED : October 14, 2003
INVENTOR(S) : Hiroshi Iwai et al.

It is certified that error appears in the above-identified patent and that said Letters Patent is hereby corrected as shown below:

Title page,
Item [57], ABSTRACT,
Line 17, please replace “shot-circuiting” with -- short-circuiting --.

Column 14,
Line 48, please replace “junctionto” with -- junction to --.

Column 15,
Line 57, please replace “bards” with -- bands --.

Signed and Sealed this

Twentieth Day of April, 2004

JON W. DUDAS
*Acting Director of the United States Patent and Trademark Office*